US010618147B2

(12) United States Patent
Chen

(10) Patent No.: US 10,618,147 B2
(45) Date of Patent: Apr. 14, 2020

(54) CONTROL DEVICE FOR RATCHET WRENCH

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 231 days.

(21) Appl. No.: 15/824,040

(22) Filed: Nov. 28, 2017

(65) Prior Publication Data

US 2018/0079057 A1 Mar. 22, 2018

Related U.S. Application Data

(63) Continuation-in-part of application No. 14/469,591, filed on Aug. 27, 2014, now abandoned.

(51) Int. Cl.
*B25B 13/46* (2006.01)
*B25B 23/00* (2006.01)

(52) U.S. Cl.
CPC ..... *B25B 13/465* (2013.01); *B25B 13/462* (2013.01); *B25B 23/0035* (2013.01)

(58) Field of Classification Search
CPC ..... B25B 13/465; B25B 13/462
See application file for complete search history.

(56) References Cited

U.S. PATENT DOCUMENTS 4,211,127 A * 7/1980 D'Oporto ..... B25B 13/465 81/177.85
2006/0032341 A1* 2/2006 Shu-Sui ..... B25B 13/465 81/63
2010/0043604 A1* 2/2010 Chen ..... B25B 13/465 81/63.2

* cited by examiner

*Primary Examiner* — Bryan R Muller
(74) *Attorney, Agent, or Firm* — Rosenberg, Klein & Lee

(57) ABSTRACT

A ratchet wrench includes a hole in which a driving member and a pawl are received. The pawl is engaged with toothed face of the hole of the head. The driving member has a protrusion. An operation rod extends through the driving member and connected with a positioning unit. A bead is movably received in the protrusion of the driving unit and cooperated with an operation rod. When pushing the positioning unit, the operation rod is moved and the bead is submerged in the protrusion to release or to connect with a socket to the protrusion. The pawl includes a slot that extends in the radial direction of the hole in the head. A control member is rotatably engaged with the hole and includes a stud inserted into the slot. A resilient member is located in the slot and biased between the stud and the inner end of the slot.

4 Claims, 5 Drawing Sheets

CONTROL DEVICE FOR RATCHET WRENCH

FIELDS OF THE INVENTION

The present invention is a Continuation-In-Part application of applicant former patent application of patent application Ser. No. 14/469,591, filed on Aug. 27, 2014, currently pending.

BACKGROUND OF THE INVENTION

Descriptions of Related Art

The conventional ratchet wrenches are used to be cooperated with a socket so as to tighten or loosen an object such as a nut or a bolt. The conventional ratchet wrenches have a ratchet device so as to allow the user to tighten or loosen an object without removing the wrench from the object. However, the ratchet device comprises many parts and some of which are small so that when assembling these parts into a limited space of the wrench, the assemblers have to concentrate and spend a lot of time.

A conventional wrench known to applicant discloses a control disk which is rotatably connected to the top of the driving member. The control disk has a circular recess and a stepped face is defined in the underside of the control disk. A groove is defined in the outside of the protrusion of the driving member and a clip is engaged with the groove. The clip partially protrudes from the outside of the protrusion. The clip is located above the stepped face, so that the control disk is restricted between the protrusion and the clip. By this way, the control disk is secured.

However, relationship of position between the clip and the coil spring is not stable. Although the coil spring is positioned by the operation rod, the coil spring tends to shift a small distance when it is compressed. Besides, the circular slot is so small so that the clip is difficult to be engaged with the groove. The clip sometimes even hits the control disk.

Besides, U.S. Patent Publication No. 2010/0043604 to Chen discloses a similar ratchet wrench and includes a heart-shaped spring which is coupled to a control member rotatably located on the top of the head of the ratchet wrench. The heart-shaped spring has a leg which is inserted into a top hole of the pawl so that when the control member is rotated, the pawl is moved to change the operational direction of the ratchet wrench. Nevertheless, the spring located between the press disk and the nut does not provide a proper positioning structure for positioning the spring biased between the press disk and the nut. Haznar (U.S. Pat. No. 3,532,013) discloses a wrench with stop for positioning the spring.

It is noted that the heart-shaped spring is mounted to the connection rod, and the stud on the control member is coupled at one corner of the heart-shaped spring, and the leg that is inserted into the pawl of the heart-shaped spring is located diametrically opposite to the corner to be coupled with the stud. Understandably, the shape of heart-shaped spring of Chen is not easily to maintain and can easily be deformed. In other words, once the heart-shaped spring is improperly deformed, the pawl cannot be moved to the position as expected. Therefore, the operational direction of the ratchet wrench cannot be properly changed.

The present invention intends to provide a control device for a ratchet wrench, and the control device directly controls the pawl so as to eliminate the shortcomings mentioned above.

SUMMARY OF THE INVENTION

The present invention relates to a ratchet wrench and comprises a head and a handle which is formed with the head. The head includes a hole defined through the top and the bottom of thereof. The hole includes a toothed face defined in the inner periphery thereof. A driving unit comprises a driving member, a pawl, a resilient member and an operation rod. The driving member is located in the hole of the head. A connection rod extends from the top end of the driving member, and a protrusion extends from the bottom end of the driving member. The driving member has a recess defined in a curved outside thereof. The pawl is movably located in the recess and has teeth defined in the outside thereof. The teeth of the pawl are engaged with the toothed face of the hole of the head. The pawl has a slot defined in the top thereof and the axis of the slot is located on the radial direction of the hole of the head. The resilient member is received in the slot. A bead is engaged with the protrusion. The operation rod extends into the protrusion of the driving member and extends through the connection rod. A notch is defined in the outside of the operation rod and the bead is engaged with the notch.

A control member is partially and rotatably located in the hole of the head and includes a circular recess defined in the top thereof. An oval slot is defined through the inner end of the circular recess. The connection rod extends through the oval slot. The control member has a stud extending from the underside thereof, and the stud is inserted into the slot of the pawl. The resilient member is biased between the stud and an inner end of the slot. The resilient member biases the pawl in the radial direction of the hole to engage the teeth of the pawl with the toothed face of the hole of the head.

A positioning unit comprises a nut, a spring and a press disk. The nut is located in the circular recess of the control member and connected to the connection rod. The underside of the nut contacts the inner end of the circular recess. A flange extends axially from the top of the nut. The spring is mounted on the flange and is biased between the nut and the press disk. The press disk is movable within the circular recess. A fastener extends through the press disk and is connected to the operation rod.

Preferably, the notch of the operation rod comprises a first notch and a second notch. The depth of the first notch is deeper than that of the second notch. When the bead is engaged with the first notch, the bead is submerged in the protrusion of the driving member. When the bead is engaged with the second notch, a portion of the bead protrudes from the protrusion.

Preferably, an area of the circular recess and an area of the nut are both larger than the oval slot.

The primary object of the present invention is to provide a ratchet wrench wherein the control member has a stud inserted into the slot of the pawl to control the movement of the pawl. A resilient member is biased between the stud and an inner end of the slot, such that the pawl is able to move in the radial direction of the hole of the head.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
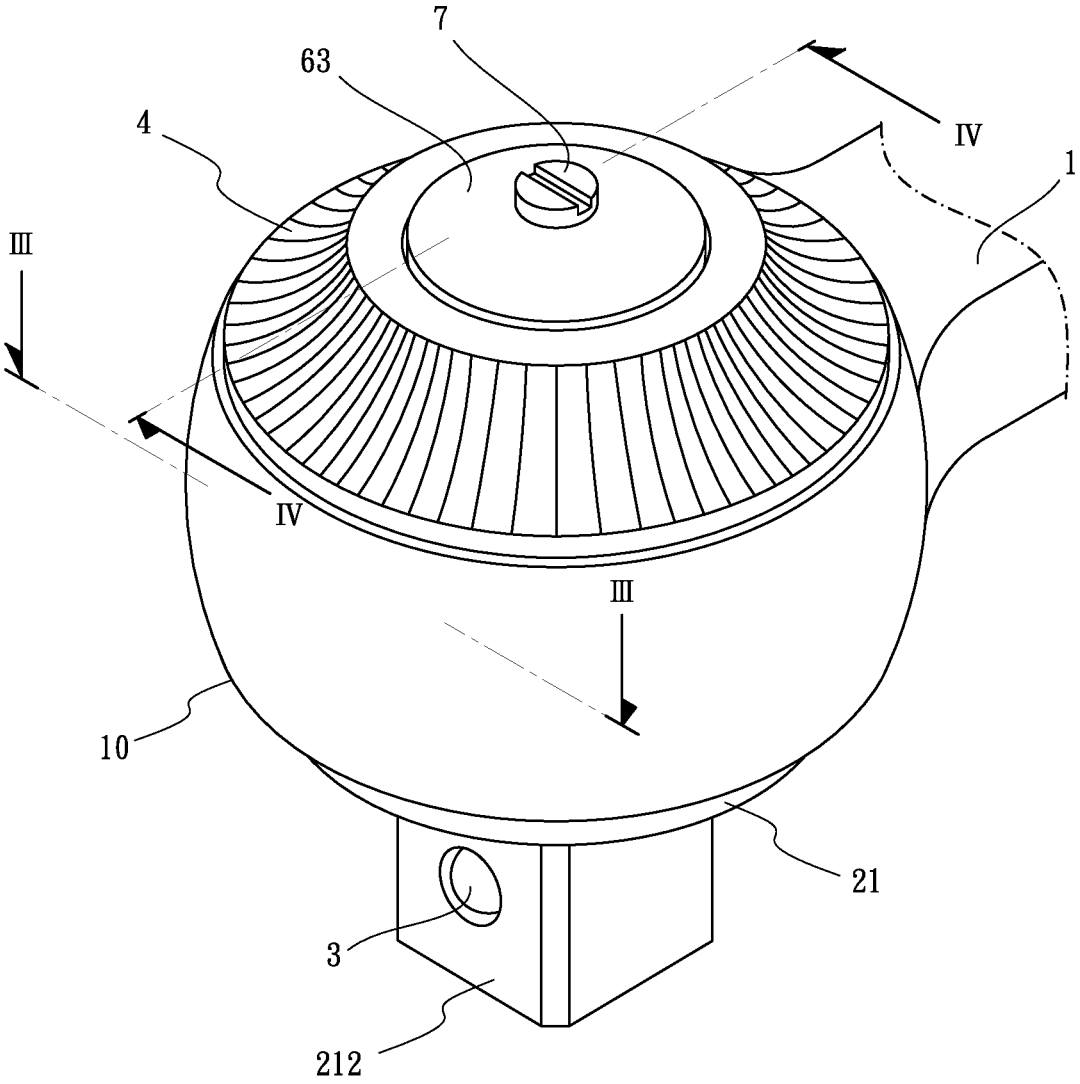
FIG. 1 is a perspective view of the ratchet wrench of the present invention.
Figure 2:
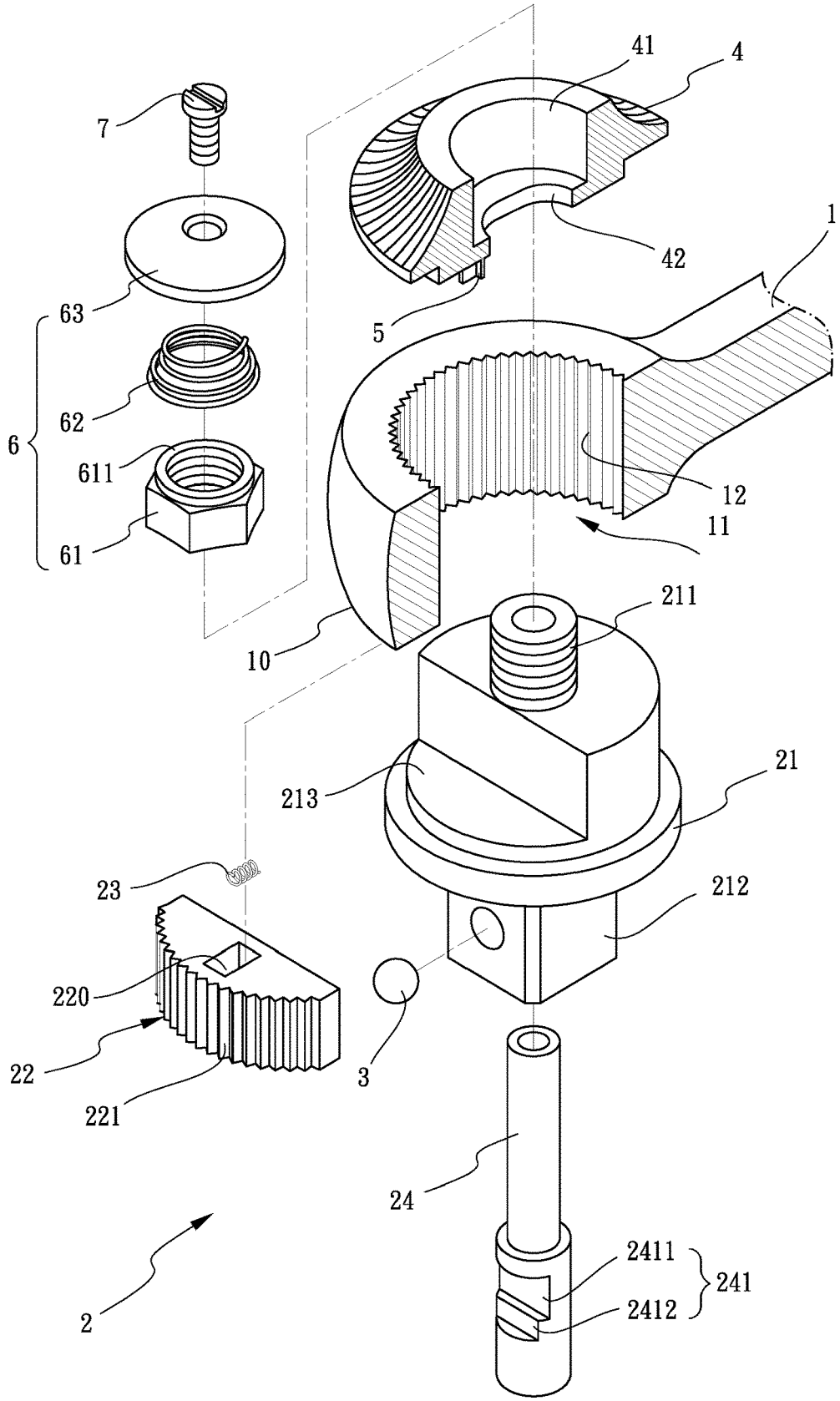
FIG. 2 is an exploded view of the ratchet wrench of the present invention.

Referring to FIGS. 1 to 4, the ratchet wrench of the present invention comprises a head 10 and a handle 1 which is formed with the head 10. The head 10 includes a hole 11 defined through the top and the bottom of thereof. The hole 11 includes a toothed face 12 defined in the inner periphery thereof. A driving unit 2 comprises a driving member 21, a pawl 22, a resilient member 23 and an operation rod 24. The driving member 21 is located in the hole 11 of the head 10. The driving member 21 has a recess 213 defined in a curved outside thereof. The pawl 22 is movably located in the recess 213 and has teeth 221 defined in the outside thereof. The teeth 221 of the pawl 22 are engaged with the toothed face 12 of the hole 11 of the head 10. The pawl 22 has a slot 220 defined in the top thereof and the axis of the slot 220 is located on the radial direction of the hole 11 of the head 10. The resilient member 23 is received in the slot 220. A connection rod 211 extends from the top end of the driving member 21, and a protrusion 212 extends from the bottom end of the driving member 21. A bead 3 is engaged with the protrusion 212. The protrusion 212 is used to be connected with an object (not shown) such as a socket (not shown). The operation rod 24 extends into the protrusion 212 of the driving member 21 and extends through the connection rod 211 which includes a threaded outside. A notch 241 is defined in the outside of the operation rod 24 and the bead 3 is engaged with the notch 241. The notch 241 of the operation rod 24 comprises a first notch 2411 and a second notch 2412. The depth of the first notch 2411 is deeper than that of the second notch 2412.

A control member 4 is partially and rotatably located in the hole 11 of the head 10 and includes a circular recess 41 defined in the top thereof. An oval slot 42 is defined through the inner end of the circular recess 41. The connection rod 211 extends through the oval slot 42. The control member 4 has a stud 5 extending from the underside thereof, and the stud 5 is inserted into the slot 220 of the pawl 22. The resilient member 23 is biased between the stud 5 and one inner end of the slot 220. The resilient member 23 biases the pawl 22 in the radial direction of the hole 11 to engage the teeth 221 of the pawl 22 with the toothed face 12 of the hole 11 of the head 10.

A positioning unit 6 comprises a nut 61, a spring 62 and a press disk 63. The nut 61 is located in the circular recess 41 of the control member 4 and is threadedly connected to the connection rod 211. The underside of the nut 61 contacts the inner end of the circular recess 41. A flange 611 extends axially from the top of the nut 61. The spring 62 is mounted on the flange 611 and is biased between the nut 61 and the press disk 63. The spring 62 is guided and positioned by mounting one end of the spring 62 to the axial flange 611. The press disk 63 is movable within the circular recess 41. A fastener 7 extends through the press disk 63 and is connected to the operation rod 24. The area of the circular recess 41 and the area of the nut 61 are both larger than the oval slot 42, so that the nut 61 does not drop through the oval slot 42.

Figure 5:
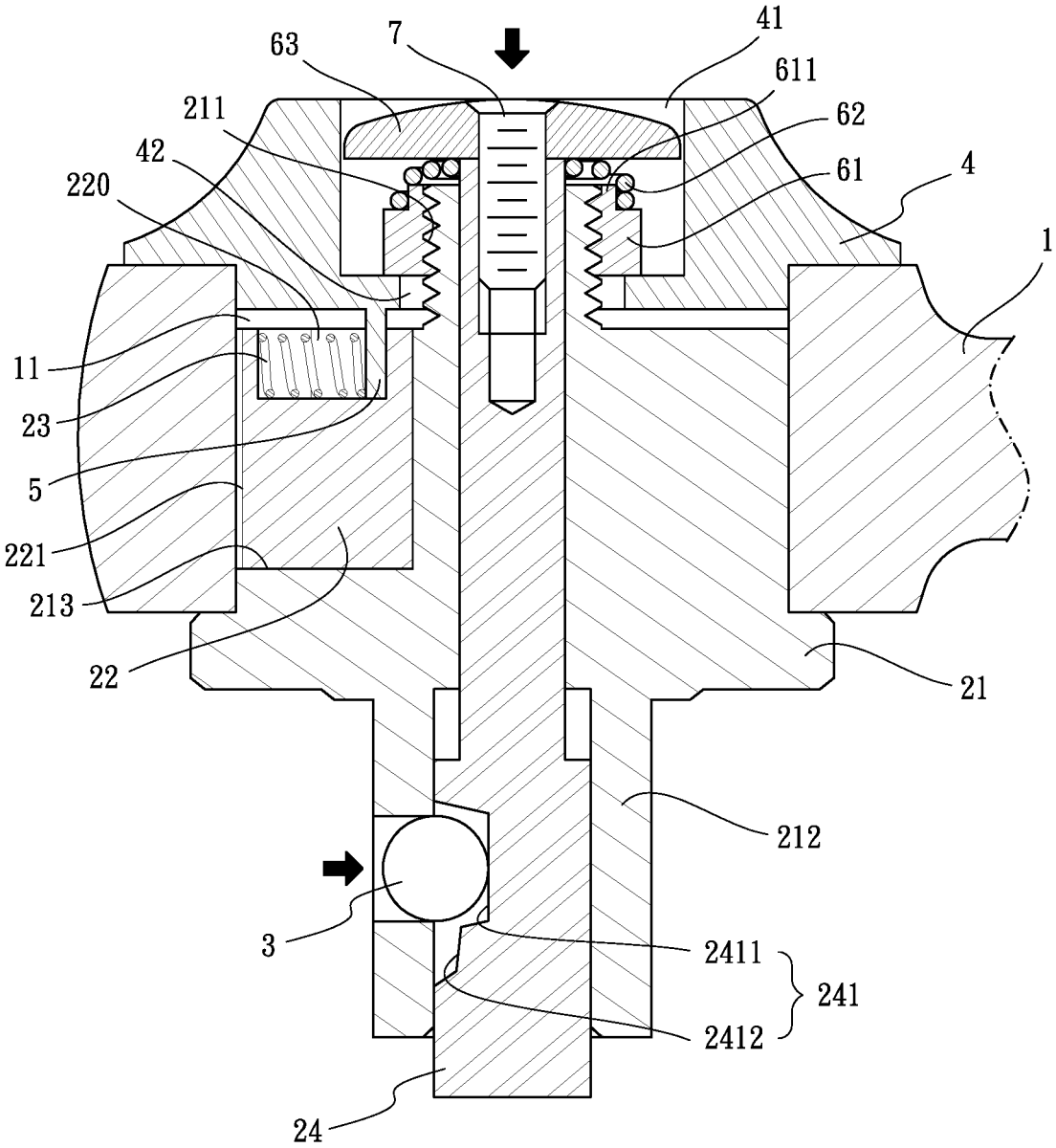
FIG. 5 is a cross sectional view to show that the press disk compresses the spring, and the bead is completely merged into the protrusion of the driving unit.

When the press disk 63 is pushed toward the nut 61, as shown in FIG. 5, the spring 62 is compressed and because the connection rod 211 is fixed to the press disk 63 by the fastener 7, so that the driving member 21 is lowered with the press disk 63. The bead 3 is removed from the second notch 2412 to the first notch 2411, so that the bead 3 is submerged in the protrusion 212 of the driving member 21. Therefore, the socket can be easily removed from or connected to the protrusion 212 when the bead 3 is submerged in the protrusion 212 of the driving member 21. When the bead 3 is engaged with the second notch 2412, a portion of the bead 3 protrudes from the protrusion 212 such that the socket is secured by the urging force from the bead 3.

Figure 3:
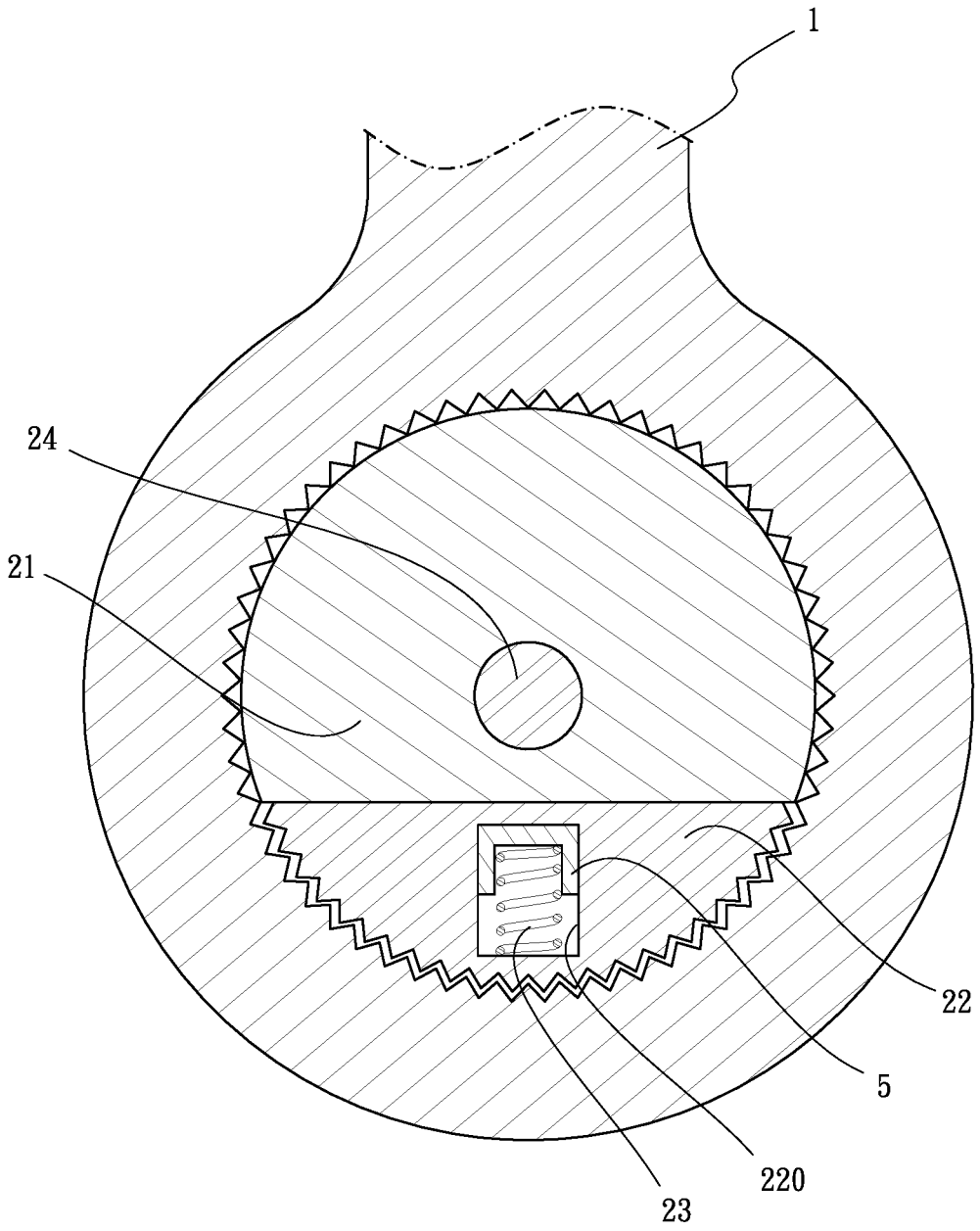
FIG. 3 is a cross sectional view, taken along line III-III in FIG. 1.
Figure 4:
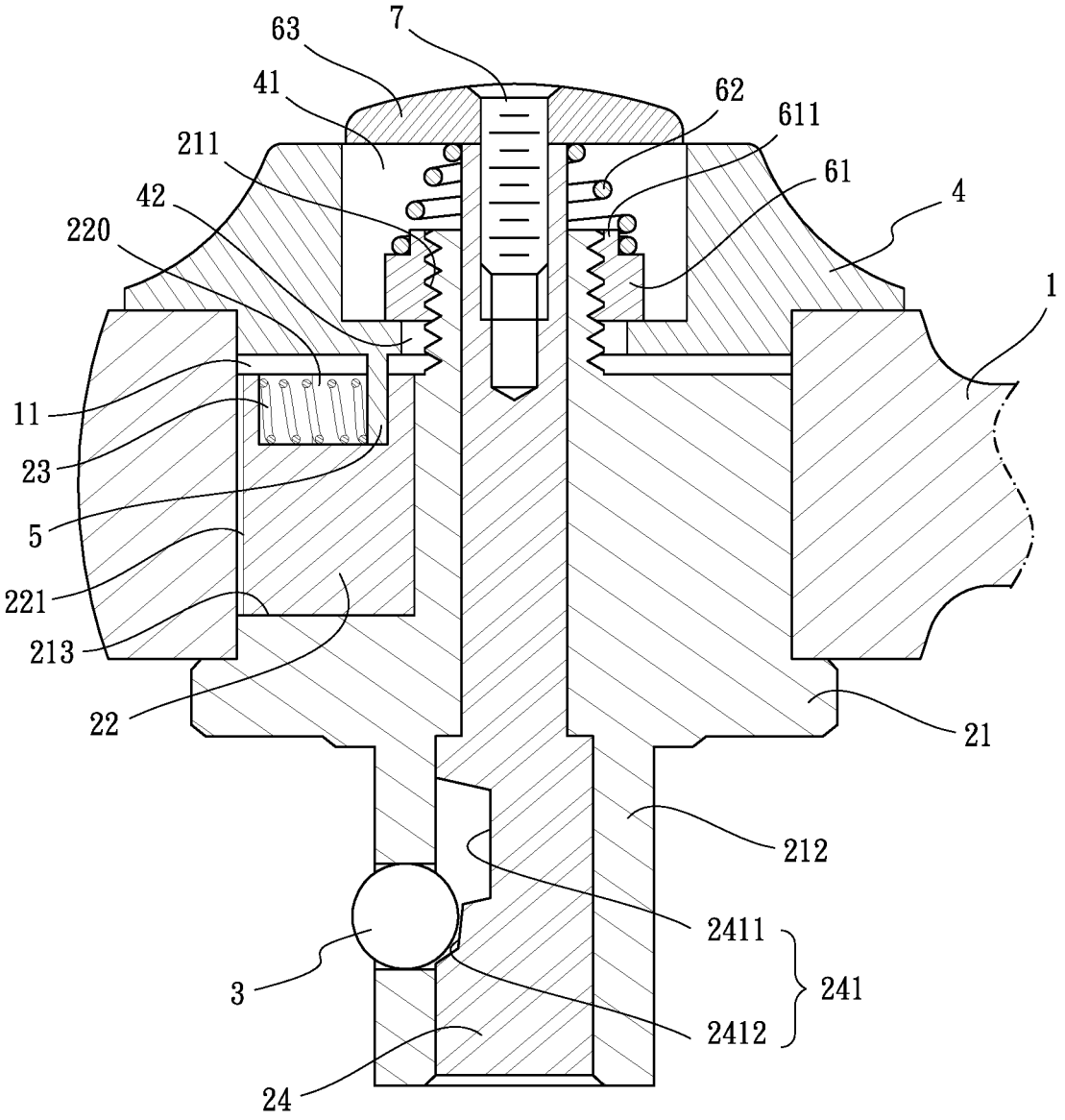
FIG. 4 is a cross sectional view, taken along line Iv-Iv in FIG. 1, wherein the press disk has not yet compressed the spring, and the bead partially protrudes from the protrusion of the driving unit.

As shown in FIG. 3, the resilient member 23 provides a force that is applied along the radial direction of the hole 11, and the force effectively engage the teeth 221 of the pawl 22 with the toothed face 12 of the hole 11. Specifically, the stud 5 includes a U-shaped cross section, and the other end of the resilient member 23 is inserted and restricted in the U-shaped stud 5. By this way, the resilient member 23 is well positioned and ensures that when the ratchet wrench is rotated and does not output torque to the object, because the stud 5 of the control member 4 is not moved, the pawl 23 is pushed toward the driving member 21 by the toothed face 12 of the hole 11. The resilient member 23 is compressed against the stud 5 and does not twist to allow the head 10 to rotate relative to the pawl 22. The pawl 22 is directly shifted by rotating the control member 4 and can be precisely moved when compared with the heart-shaped spring used in the conventional ratchet wrench mentioned above.

While we have shown and described the embodiment in accordance with the present invention, it should be clear to those skilled in the art that further embodiments may be made without departing from the scope of the present invention.

What is claimed is:

1. A ratchet wrench comprising:

a head and a handle which is formed with the head, the head having a hole defined through an end thereof, the hole having a toothed face defined in an inner periphery thereof;

a driving unit having a driving member, a pawl, a resilient member and an operation rod, the driving member located in the hole of the head, a connection rod extending from a top end of the driving member and a protrusion extending from a bottom end of the driving member, the driving member having a recess defined in a curved external portion thereof, the pawl having a top surface, bottom surface and a plurality of sides extending between the top and bottom surfaces, the pawl being located in the recess and having teeth defined on at least one of the plurality of sides, the teeth of the pawl engaged with the toothed face of the hole of the head, the pawl having an elongated slot extending into the pawl through the top surface thereof and a longitudinal axis of the slot extending in a direction aligned with a radial direction of the hole of the head, the resilient member received in the slot, a bead engaged with the protrusion, the operation rod inserted into the protrusion of the driving member and extending through the connection rod, a notch defined in an outside of the operation rod and the bead engaged with the notch;

a control member partially and rotatably located in the hole of the head and having a circular recess defined in a top thereof, an oval slot defined through an inner end of the circular recess and the connection rod extending through the oval slot, the control member having a stud extending from an underside thereof, the stud being positioned substantially within the slot of the pawl adjacent to a first longitudinal end of the slot, the resilient member biased between the stud and a second longitudinal end of the slot opposite the first end, the resilient member biasing the pawl in the radial direction of the hole to engage the teeth of the pawl with the toothed face of the hole of the head, and a positioning unit having a nut, a spring and a press disk, the nut located in the circular recess of the control member and connected to the connection rod, an underside of the nut contacting the inner end of the circular recess, a flange extending axially from a top of the nut, the spring mounted on the flange and being biased between the nut and the press disk, the press disk being movable within the circular recess, a fastener extending through the press disk and connected to the operation rod.

2. The ratchet wrench as claimed in claim 1, wherein the notch of the operation rod comprises a first notch and a second notch, a depth of the first notch is deeper than that of the second notch, when the bead is engaged with the first notch, the bead is submerged in the protrusion of the driving member, when the bead is engaged with the second notch, a portion of the bead protrudes from the protrusion.

3. The ratchet wrench as claimed in claim 1, wherein an area of the circular recess and an area of the nut are both larger than the oval slot.

4. The ratchet wrench as claimed in claim 1, wherein the stud includes a U-shaped cross section, one end of the resilient member is inserted and restricted in the U-shaped stud.

* * * * *